United States Patent [19]

Rudy et al.

[11] Patent Number: 4,694,644

[45] **Date of Patent: * Sep. 22, 1987**

[54] METHOD AND APPARATUS FOR PRODUCING OVAL CHAIN LINKS FROM ROUND WIRE

[75] Inventors: Willi Rudy, Iserlohn; Gerhard Lange, Reutlingen, both of Fed. Rep. of Germany

[73] Assignee: Wafios Maschinenfabrik GmbH & Co. KG, Fed. Rep. of Germany

[ * ] Notice: The portion of the term of this patent subsequent to Jul. 21, 2004 has been disclaimed.

[21] Appl. No.: 796,214

[22] Filed: Nov. 8, 1985

[30] Foreign Application Priority Data

Nov. 9, 1984 [DE] Fed. Rep. of Germany ..... 3440907

[51] Int. Cl.[4] ..... B21L 1/02

[52] U.S. Cl. ..... 59/27; 59/23

[58] Field of Search ..... 59/18, 22, 23, 24, 25, 59/27, 31, 35.1; 72/461, 391, 332, 337; 140/88

[56] References Cited

U.S. PATENT DOCUMENTS

| | | | |
|---|---|---|---|
| 3,421,359 | 1/1969 | Gibbs | 72/461 |
| 3,431,723 | 3/1969 | Wattler | 59/25 |
| 3,961,474 | 6/1976 | Esser | 59/27 |
| 4,209,978 | 7/1980 | Johansson et al. | 59/27 |

FOREIGN PATENT DOCUMENTS

| | | |
|---|---|---|
| 1123891 | 6/1957 | Fed. Rep. of Germany . |
| 1527505 | 4/1965 | Fed. Rep. of Germany . |
| 2123561 | 5/1971 | Fed. Rep. of Germany . |
| 319664 | 4/1957 | Switzerland . |

*Primary Examiner*—Robert L. Spruill
*Assistant Examiner*—David B. Jones
*Attorney, Agent, or Firm*—Wigman & Cohen

[57] ABSTRACT

A straight wire length is bent against a mandrel into an obtuse V-shape and then into a C-shape at a first station, and against another mandrel into an oval shape at a second station. When making the V-shape bend the leading edge of the wire length is thereby contained against perpendicular movement. The wire length is then bent into a C-shape and when it is moved from the first station to the second station the stop is pivoted against the force of the spring by a bar transforming the V-shape to the C-shape. When the emerging C-shaped link clears the support surface of the stop element, the spring returns the stop element to its initial position in the first bending station, against a stop. The surface of the stop element contacting the stop may serve as an electrical contact for process control. Also, in the first station the vertical space between the straight wire length and the leading edge of the mandrel is greater than the diameter of the wire, thus clearing the path of the feed of the straight wire length into the first station for high productivity at least during the transport of the C-shaped wire piece from the first station to the second station.

7 Claims, 1 Drawing Figure

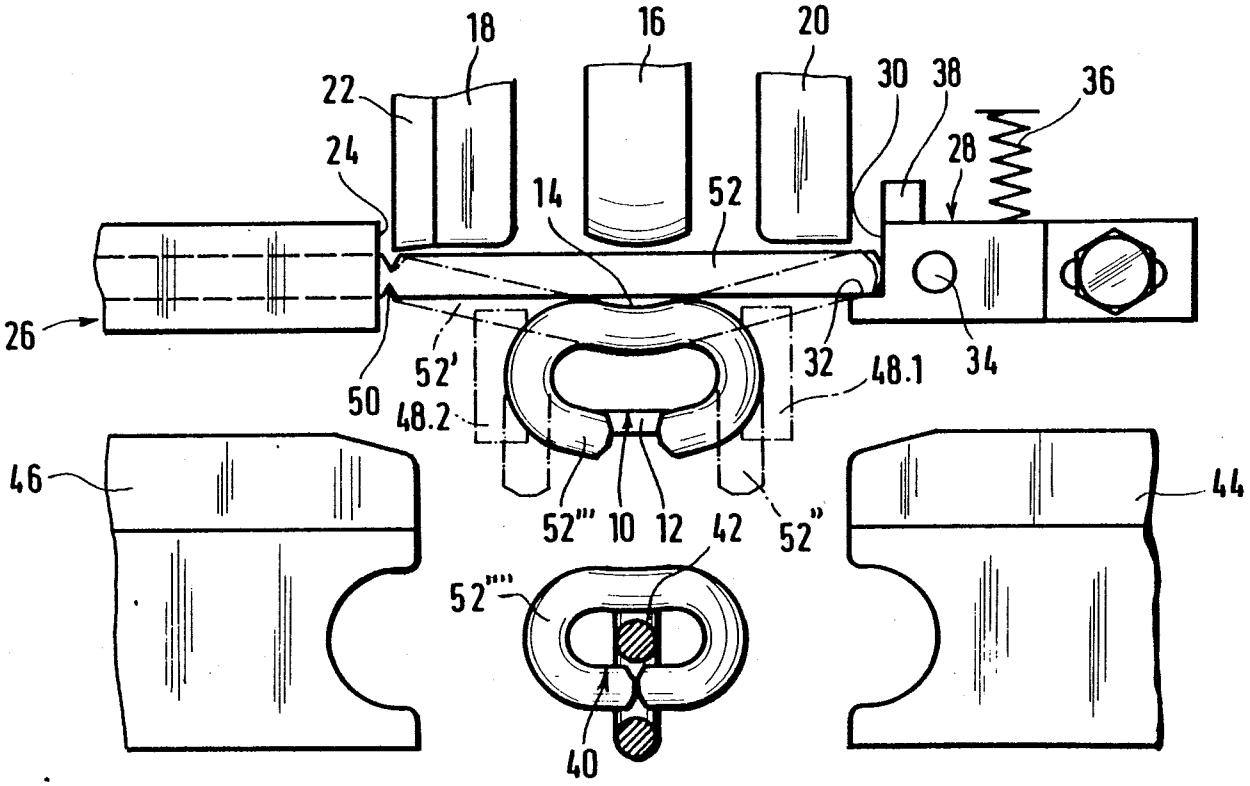
36
38
28
30
20
16
18
22
24
26
34
32
52
14
48.1
52"
52'
48.2
50
44
42
12
10
52'''
52''''
40
46

METHOD AND APPARATUS FOR PRODUCING OVAL CHAIN LINKS FROM ROUND WIRE

BACKGROUND OF THE INVENTION

The invention relates to a method for the manufacture of oval chain links out of round wire. A straight wire length, which perpendicularly crosses the longitudinal axis of a cylindrical bending mandrel having an annular groove surrounding this axis in a vertical plane to receive the wire length, is brought toward the mandrel at the level of the groove but spaced therefrom. The center of the wire length which forms the back of the link is moved into a recess in the mandrel at its entry side and in line with the groove therein. The wire length separated from the wire is bent into the groove outside of the mandrel recess until the longitudinal axis of the wire length follows the course of the groove; and to an apparatus for performing the method, having a bending mandrel, which has a recess on the wire delivery side of the mandrel to receive the outwardly concave curved back section of the unwelded chain link, the center of which recess if arranged opposite a holder for the length which can slide forward and back normally to the longitudinal axis of the mandrel; having two wire bending tools arranged symmetrically at the sides of the mandrel and holder, which tools can be moved on the side of the mandrel opposite the holder from the holder side of the mandrel toward the two ends of the wire end or piece positioned between the mandrel and the holder; and having a device for positioning the wire length between the mandrel and holder, which has a wire feed sleeve which is stationary or can be moved with one of the two tools, and has a stop element for the emerging free end of the wire length, said stop element lying axially opposite said wire feed sleeve, whereby the wire bending tools can be moved out beyond the mandrel and back perpendicularly to the wire feed direction and parallel to the direction of movement of the holder toward the two ends of the positioned wire length.

A device of the aforementioned type is described in German Patent No. DE-AS 1 527 505, where a method of the type described above can be performed. Wire length, or pins, of a given equal lenth are worked. The pins are first cut at the pin length discontinuously from a wire end that is pushed through the feed sleeve (knife sleeve 11) until it abuts the plate-like stop element (stop plate 21), said cutting occurs by means of a blade (12) in the plane of the frontal surface (28) of the feed sleeve (11) facing the parallel stop surface (29) of the stop plate (21), which blade is parallel to the two bending tools (bending steels 14) and is moved together therewith. Correspondin to the blade (12) on the feed sleeve (11) associated with the pin end to be cut is a sliding steel (24) on the stop plate (21) which is associated with the free pin ends and is identical with the respective leading free end of the wire end, which stop plate (21) is aligned with and simultaneously can be moved along with the two bending tools (14) of the stop surface (29), so that the frontal surface (18) of the free pin end, which is a cutting surface, while the changing of the straight pin into a wire piece with complete back bending of the produced chain link, which is effected exclusively by means of the holder (27) pushing against the bending mandrel (16), is not distorted. The changing of the bird wing-like wire length into a C-shaped wire length then takes place by means of the two bending tools (14), which are followed by the ineffective blade (12) and the sliding steel (24). Subsequently, two additional bending tools (bending steel 30) which can be moved together and apart in the plane on which the mandrel axis lies vertically, effect a changing of the C-shape of the wire length into an O-shape, which, of course, exhibits the back rounding of the now finished unwelded chain links. According to FIG. 2 of German Patent No. DE-AS 1 527 505, the lateral distance of the pin from the mandrel (16) is just one times the wire diameter; which corresponds to a vertical spacing of the longitudinal axis of the feed sleeve (11) from the cord lying tangent to the mandrel (16) of just one and one half times the wire diameter. This spacing would not be met with the observation that could be led back to the fact that in the known method the preliminary and finish bending take place in one and the same bending station, so that in any case one must wait for the completion of each unwelded chain link before the next pin receives the back bending in a first step of its shaping into the O-shape with a back rounding.

It appears disadvantageous to the known apparatus, the operational method of which corresponds to the method performed therewith, that as the wire end is moved into the single (or first) bending station one must always wait until the bent wire length has obtained its open O-shape (or closed C-shape), because until then the back of the portion of the unwelded chain link to be produced at least partially occupies the space between the mandrel and the holder, so that as it moves forward, the wire end would be prevented from reaching the stop element by this back portion. Consequently, the machine production of unwelded chain links is not as high as it could be, if this mentioned limitation did not exist.

OBJECTS AND SUMMARY OF THE INVENTION

One object of the present invention, therefore, is to provide a method for the production of oval chain links from round wire. Another object of the present invention is to provide apparatus for performing such method in such a manner that a relatively high productivity (measured in finish bent, unwelded chain links per unit of time) can be achieved. Other objects will become apparent from the description which follows.

These objects are achieved according to the invention with a method of the above-described type, where the wire length is first bent into an obtuse V-shape on the mandrel, as taught in No. DE-AS 21 23 561. And additionally, to the following end of the wire length, the leading free end is also prevented from significantly moving perpendicularly relative to the longitudinal and feed direction of the straight wire length during the first bending of the wire length and the simultaneous moving of the center thereof into the mandrel recess. Thus, in the preliminary bending of a wire length into a C-shape, which takes place in a first station, which C-shaped wire is then closed in a second station for the final bending of the wire length into an O-shape, a vertical spacing of the straight wire length amounting to at least the diameter of the wire is maintained from the two adjacent points of the groove base. After the preliminary bending of the wire length into a C-shape the new or next wire length is transported to the position adjacent the mandrel of the preliminary bending station.

In this manner it is advantageously achieved that after the changing of the V-shape into the C-shape of the wire length, the path from the feed sleeve to the stop element for the next wire length can be freed, so that the performance capacity of the machine can be increased relatively, whereby the desired increase in productivity actually occurs when the new or next wire length is pushed into the first station and is first bent into the V-shape during the transport of the preceding closed C-shaped or open O-shaped wire length from the first to the second station, and thereafter the mandrel is freed.

In a preferred manner of performing the method according to the present invention, the trailing length of the wire end is partially separated from the wire by notching in a notching station arranged in front of the first bending station, and that the partially separated wire length is completely separated in the first bending station, after it is first bent into the V-shape length at the same time as or before its V-shape is changed into a C-shape.

The above-mentioned objective on which the invention is based, is achieved in an apparatus of the above-described type according to the invention, in that the longitudinal axis of the guide sleeve in its guiding position and the cord stretching over the recess (14) of the mandrel (10) and tangent thereto have a vertical spacing from each other parallel to the sleeve axis which is at least one and one half times the diameter of the wire; in that the stop element (28) has a support surface (32) for the free end of the wire length (52) flanking the sleeve axis, which support surface is arranged such that it can be moved out of the way of this free end to allow an unrestricted changing of the V-shape of the wire end or piece into its C-shape; and in that the support surface (32) of the stop element (28) is arranged laterally to the direction of movement of the work tools (18, 20) and can be separated from the free end of the wire length (52) for an unrestricted changing of the V-shape thereof into the C-shape thereof. By means of this small expense, which consists almost exclusively of a simple forming of the stop element and making same movable, the method according to the invention can be advantageously performed.

In a preferred embodiment of the apparatus according to the invention, it is provided that the support surface of the stop element can be removed from the free end of the wire length, which is arranged parallel to the mandrel axis; by mounting same so that it can rotate about an axis; and that the stop element can be locked in its effective position blocking its removal rotation direction, where it is rotated into its ready position as a stop and support. To release the forward free end of the wire length after the first bending into the V-shape, one need only raise the block to the stop element, whereupon this stop elementdeflects out of the way of a wire length acted upon by a bending tool and can be carried along therewith.

The preferred embodiment is distinguished by a spring which produces a torque on the stop element and by a stop which cooperates therewith, against which stop the stop element lies in its ready position under the effect of the spring biasing. This eliminates an expensive program-controlled back rotation of the stop element after its displacement by the leading free end of the wire length acted upon by a bending tool. The support surface of the stop element can be selectively removed from the free end of the wire length by a movement thereof in the direction of the wire feed.

In addition, in the preferred embodiment the feed sleeve and the stop surface of the stop element are provided as the two halves of an electrical switch contact, which can be part of an electrical system for the sequence control of the apparatus according to the invention, and where necessary can protect against machine damage, which can occur if a wire length is bent that has not been pushed all the way to the stop.

BRIEF DESCRIPTION OF THE DRAWING

The invention is described in greater detail below with the aid of the exemplary embodiment of the apparatus according to the invention illustrated in the drawing. The single FIGURE of the drawing schematically shows a view of this preferred embodiment having two stations for preliminary and finish bending.

DETAILED DESCRIPTION OF THE PREFERRED EMBODIMENTS

The preferred embodiment of the apparatus according to the invention is a two mandrel bending machine for performing the conventional two mandrel bending method, in which the bending process is divided between two stations which are illustrated one above the other in the drawing. A wire length positioned in the first, preliminary bending station, is curved approximately into the shape of a C and the C-shaped wire length is curved approximately into an O-shape in the second, finish bending station. The preliminary bending takes place thereby in such a manner that the straight wire length, which is partially separated from the preceding wire length by means of a notching device (not shown), is first bent into an obtuse V-shape, in order to produce the back bending desired for the welding of the chain link produced from the wire length, which back bending projects in the middle against the welding point of the unwelded chain link. In its preliminary bending station illustrated at the top in the drawing, the embodiment is provided with an essentially cylindrical bending mandrel 10, which extends with its longitudinal axis perpendicular to the plane of the drawing and is provided with an annular groove 12 half of which is visible in the drawing and projects into the plane of the drawing, and which has a cylindrical shape adapted to the diameter of the round wire to be worked. The course of the annular groove 12 approximately follows the shape of the circumference of a beam, so that a recess 14 in the mandrel is located on the wire feed side of the mandrel to receive the outwardly concave, curved back portion of the unwelded chain link to be manufactured, the center of which recess 14 lies opposite a holder 16 which can be moved forward and back perpendicular to the mandrel axis in the drawing plane to hold a wire piece in place in the mandrel recess 14. Two preliminary bending tools 18, 20, which are arranged on different sides of the holder can be moved forward and back parallel to the holder 16 in the plane of the drawing. In their movement relative to the mandrel 10, the two preliminary bending tools 18 and 20 maintain lateral spacing from the narrow sides of the bending mandrel. A cutting blade 22 is rigidly connected with the preliminary bending tool 18 associated with the trailing end of a wire piece. The cutting blade 22 is arranged on the side of the preliminary bending tool 18 opposite the holder 16 in the vicinity of the frontal surface 24 of a wire feed sleeve 26, the longitudinal axis of which lies in the plane of the drawing and the direction of movement of the cutting blade 22 (and also therewith the direction of movement of the preliminary bending tools 18 and 20 and the holder 16) on the one hand and the longitudinal axis of the bending mandrel 10 on the other hand cross at right angles. With regard to the extended longitudinal axis of the feed sleeve 26, the two preliminary bending tools 18 and 20 and the holder 16 when they are retracted from the bending mandrel 10, are located on one side of this extension, while the mandrel is always located on the other side thereof. A stop element 28 lies opposite the feed sleeve 26 at such a distance in the wire feed direction that the two preliminary bending tools 18 and 20 and the holder 16 on the one hand and the bending mandrel 10 on the other hand are located in the intermediate space. The stop element 28 has a stop surface 30 lying axially opposite the frontal surface 24 of the feed sleeve 26 in its illustrated ready position and a support surface 32 with edge chamfers adjoining the same at a right angle, which support surface 32 faces the retracted preliminary bending tool 18 and faces opposite the bending mandrel 10. The stop element 28 is pivotable about a rotational axis 34 that is parallel to the longitudinal axis of the mandrel 10, which rotational axis 34 intersects the wire feed direction at a right angle. The stop element 28 is a lever-like structure, one arm of which has the surfaces 30 and 32 and the other arm of which is acted upon by a spring 36 in such a manner that the stop element normally is rotated into its illustrated ready position, where it abuts a stop 38.

In the finish bending station illustrated below in the drawing, the embodiment has a second bending mandrel 40, which receives the previously manufactured unwelded chain link in a recess 42 and cooperates with two lateral finish bending tools 44 and 46, which while moving toward each other relative to the bending mandrel 40, not only yield an essentially O-shaped, unwelded chain link 52, but also simultaneously take hold of the C-shaped wire piece 52 produced in the preliminary bending station at its two free ends and bring it into an opened oval shape 52 in the space between the approaching free wire ends. The wire of the previously finished curved chain link is introduced through this space into the still-to-be-finished next chain link. The transpsort of each pre-bent chain link 52 out of the first station into the finish bending station is performed by a bar 48, the two halves of which 48.1 and 48.2 take hold of the semicircular round ends of the pre-bent chain link.

The method of operation of the embodiment, which otherwise can be formed in any desired manner, and which method coincides with the method according to the invention, is as follows:

Beginning from the condition illustrated in the drawing, in which a straight wire length 52, which has been partially separated from the wire at the leading wire end by a notch 50, lies between the frontal surface 24, the feed sleeve 26 and the stop surface 30 of the ready-positioned stop element 28, which in the exemplary embodiment is rotated into its ready position, whereby the leading free end of the wire length 52 contacts the stop surface 30 of the stop element 28, which is used as an electrical contact surface, and contacts the support surface 32 thereof, and whereby the notch 50 is located immediately outside the feed sleeve 26 at the point of intersection of the sleeve axis and the effective line of the cutting blade 22.

The most important thing about this beginning condition is that the small vertical space of the wire length 52 from the base of the annular groove 12 is larger at the two ends of the recess 14 of the first bending mandrel 10 than the diameter of the wire piece 52. The mandrel 10 must be withdrawn laterally from the extended sleeve axis by a corresponding distance. In addition, the holder 16 and the two preliminary bending tools 18 and 20 are spaced from the wire piece 52 and positioned on the side of the wire length 52 opposite the bending mandrel 10 then, when the holder 16 first is moved toward the bending mandrel 10 and thereby strikes against the center of the wire length 52, if sufficient force is exerted, the wire length 52 yields and is forced toward the mandrel 10 until the holder 16 has conformed the center of the wire length 52 to the mandrel recess 14. Because in so doing the leading free end of the wire length 52 is prevented by the support surface 32 and the trailing end at the notch point 50 is prevented by the next wire piece located in the feed sleeve 26 from avoiding the pressure of the holder 16 on the wire length 52 laterally to the wire feed direction, the result of this first bending is a more or less obtuse V-shape of the wire length 52'. The force and dimension ratios must of course be selected in such a manner that the advancing of the holder 16 toward the bending mandrel 10 leads neither to a tear in the wire at the notch point 50 nor to an excess stretching of the spring 36.

After the first bending of the wire length 52', said wire length remains held against the bending mandrel 10 by the holder 16, while the two preliminary bending tools 18 and 20 are moved together with the cutting blade 22, whereby the wire is completely separated by shearing at the notch point 50 and the preliminary bending steels wrap the two straight ends of the V-shaped wire length 52' around the bending mandrel 10, until they lie parallel and thereby the C-shape of the chain link is achieved. In so doing the force of the preliminary bending tool 20 must be sufficient to allow the leading free end of the wire length 52' to force the lever arm of the stop element 28 with the support surface 32 against the return force of the spring 36, so that the yielding support surface 32 opens its pivot path to the abutting wire length end, in that the rotated stop element 28 temporarily detaches from the stop 38 in order to immediately return into its ready position, where its stop surface 30 again lies axially opposite the frontal surface 24 of the feed sleeve 26, after the leading end of the wire length 52' passes. Therefore, as long as the C-shaped wire length 52''' is transported by the bar 48 into the next station for the finish bending, the next wire length 52 can be pushed past, out of the feed sleeve 26 adjacent the bending mandrel 10 against the stop body 28, after the holder 16 and the two preliminary bending tools 18 and 20 have been retracted during the passage of the wire length 52''', so that they no longer stand in the way of the wire advance.

Although only preferred embodiments are specifically illustrated and described herein, it well be appreciated that many modifications and variations of the present invention are possible in light of the above teachings and within the purview of the appended claims without departing from the spirit and intended scope of the invention.

What we claim is:

1. In a method for the manufacture of oval chain links out of round wire, in which a straight wire length which perpendicularly crosses the longitudinal axis of a cylindrical bending mandrel having an annular groove surroundin this axis in a vertical plane to receive the wire length, is fed toward the mandrel in line with the groove but laterally spaced therefrom; in which the center of the length which forms the back of the link is moved into a recess in the mandrel on the feed side thereof and in line with the groove therein; in which the recess forms two points which are adjacent the groove base and which most closely approach the longitudinal axis of the feed of the wire length and in which the wire length separated from the wire is bent into the groove outside of the mandrel recess until the longitudinal axis of the wire length follows the course of the groove, the improvement comprising the steps of initially bending the wire length against the mandrel groove in a first bending station into the shape of an obtuse V; preventing the trailing end of the wire length and its leading free end from significantly moving perpendicularly relative to the longitudinal and feed direction of the straight wire length during the initial bending of the wire length and the simultaneous moving of the center thereof into the mandrel recess; maintaining during a prebending including the initial bending of a straight wire length, into a C-shaped wire piece which is closed in a second bending station for the final bending of the wire piece into an O-shape, in the first bending station a perpendicular spacing of the straight wire length from the two adjacent points of the groove base amounting to at least the diameter of the wire; and transporting, at the latest the next wire length during the transport of the preceding wire length to the second bending station to the position adjacent the mandrel of the first bending station after the prebending of the preceding wire piece into the C-shape.

2. Apparatus for the manufacture of oval chain links, comprising:

a bending mandrel (10) with a longitudinal axis and a wire feed side lying parallel to said longitudinal axis, which bending mandrel has a recess (14) on its wire feed side to receive an outwardly concave curved back section of the unwelded chain link;

a holder (16) for a wire length (52) which holder is arranged facing the recess (14) on the wire feed side of the mandrel (10) and which holder is arranged to slide forward and back normally to the longitudinal axis of the mandrel for cooperation with said mandrel to form a straight wire length into a V-shape therebetween;

two wire bending tools (18, 20) arranged symmetrically at the sides of the mandrel and holder, which tools (18, 20) are movable in a plane containing the sliding direction of the holder and being vertical to the longitudinal axis of the mandrel, and on the side of the mandrel opposite the holder from the holder side of the mandrel toward the ends of the wire length positioned between the mandrel and the holder up to the side of the mandrel turned away from the holder, said bending tools thereby cooperating with said mandrel and holder for forming said wire length having a V-shape into a C-shape;

means (26, 28) for positioning the wire length between the mandrel and the holder, including a stationary wire feed sleeve (26) and further including a stop element for the leading free end of the wire length, said stop element and wire feed sleeve lying in axial alignment on opposite sides of the plane defined by the direction of movement of the holder and the longitudinal axis of the mandrel, said plane being normal to the wire feed direction, whereby the wire bending tools (18) can be moved out beyond the mandrel and back perpendicularly to the wire feed direction and parallel to the direction of movement of the holder toward the two ends of the positioned wire length (52) for forming said wire length between said bending tools and said mandrel;

said wire feed sleeve (26) having its longitudinal axis extending parallel to a chord which is drawn over the recess (14) of the mandrel (10) and which is tangent to said recess, with a perpendicular spacing of said wire feed sleeve from said chord being at least one and one half times the diameter of the positioned wire length;

the stop element (28) being provided with a support surface (32) for the leading free end of the wire end (52), which supports surface flanking the sleeve axis is arranged such that it is moveable out of the way of said leading free end to allow an unrestricted changing of the V-shape of the wire length into its C-shape; and the support surface (32) at the stop element (28) being arranged perpendicularly to the direction of movement of the work tools (18, 20) and being separable from the sleeve axis by the leading free end of the wire length for said unrestricted changing of the V-shape thereof into the C-shape thereof.

3. The apparatus according to claim 2, wherein the support surface (32) of the stop element (28) is separable from the sleeve axis by the leading free end of the wire length (52) by means of the stop element being mounted so as to rotate about an axis (34) which is arranged parallel to the longitudinal axis of the mandrel; the stop element being lockable in its effective rotational position, where it is adapted to act as a stop and support.

4. The apparatus according to claim 3, further including a spring (36) connected to said stop element (28) and which produces a torque on the stop element (28);

and a stop (38) which cooperates with said spring (36), against which the stop element lies in said lockable affective rotational position under the influence of the spring force.

5. The apparatus according to claim 2, wherein the feed sleeve (26) and a stop surface (30) of the stop element (28) are provided as the two halves of an electrical switch contact for an electrical system for sequence control of said chain link manufacture apparatus.

6. The apparatus according to claim 3, wherein the feed sleeve (26) and a stop surface (30) of the stop element (28) are provided as the two halves of an electrical switch for an electrical system for sequence control of said chain link manufacture apparatus.

7. The apparatus according to claim 4, wherein the feed sleeve (26) and a stop surface (30) of the stop element (28) are provided as the two halves of an electrical switch contact for an electrical system for sequence control of said chain link manufacture apparatus.

* * * * *